US008746916B2

(12) United States Patent
Oketani et al.

(10) Patent No.: US 8,746,916 B2
(45) Date of Patent: Jun. 10, 2014

(54) SHOWCASE WITH AN ILLUMINATING APPARATUS

(75) Inventors: Tetsuya Oketani, Ota (JP); Hiroshi Okumura, Oizumi-machi (JP); Yoichi Amari, Ota (JP)

(73) Assignee: SANYO Electric Co., Ltd., Moriguchi-shi (JP)

( * ) Notice: Subject to any disclaimer, the term of this patent is extended or adjusted under 35 U.S.C. 154(b) by 496 days.

(21) Appl. No.: 12/637,128

(22) Filed: Dec. 14, 2009

(65) Prior Publication Data

US 2010/0195317 A1 Aug. 5, 2010

(30) Foreign Application Priority Data

Jan. 30, 2009 (JP) ..... 2009-019409

(51) Int. Cl.
*A47F 11/10* (2006.01)

(52) U.S. Cl.
USPC ..... 362/125; 362/126; 362/92; 362/133; 362/311.06; 362/249.02; 362/223; 362/235; 362/240; 362/260; 312/114; 312/126; 312/293.1

(58) Field of Classification Search
USPC ..... 362/92, 125, 223, 225, 260, 240, 362/249.02, 257, 296.05, 311.02, 311.06, 362/311.14, 235, 244; 312/114, 126, 293.1
See application file for complete search history.

(56) References Cited

U.S. PATENT DOCUMENTS

| | | | | |
|---|---|---|---|---|
| 6,188,185 | B1 * | 2/2001 | Ter-Hovhannisian et al. | 315/312 |
| 6,578,979 | B2 * | 6/2003 | Truttmann-Bättig | 362/92 |
| 6,736,525 | B2 * | 5/2004 | Chin | 362/235 |
| 7,063,440 | B2 * | 6/2006 | Mohacsi et al. | 362/240 |
| 7,121,675 | B2 * | 10/2006 | Ter-Hovhannisian | 362/92 |
| 7,448,768 | B2 * | 11/2008 | Sloan et al. | 362/145 |
| 7,648,251 | B2 * | 1/2010 | Whitehouse et al. | 362/223 |
| 7,954,979 | B2 * | 6/2011 | Sommers et al. | 362/217.01 |
| 2007/0047229 | A1 * | 3/2007 | Lee | 362/237 |
| 2007/0195535 | A1 * | 8/2007 | Artwohl et al. | 362/341 |
| 2008/0007945 | A1 * | 1/2008 | Kelly et al. | 362/218 |
| 2008/0037239 | A1 * | 2/2008 | Thomas et al. | 362/92 |

FOREIGN PATENT DOCUMENTS

JP 5-146346 A 6/1993

* cited by examiner

*Primary Examiner* — Thomas Sember
*Assistant Examiner* — Tsion Tumebo
(74) *Attorney, Agent, or Firm* — Westerman, Hattori, Daniels & Adrian, LLP

(57) ABSTRACT

A showcase comprising an illumination apparatus which includes a shade member constituted of a light-transmitting front wall positioned on the side of the light emitting surfaces of LED elements, and a back wall positioned on the side of a substrate provided with the LED elements, the front wall comprising a curved portion having an arc-like section and a pair of flat portions extended continuously from both ends of the curved portion to intersect with the back wall at an acute angle, corner portions where the flat portions intersect with the back wall being a pair of engaging portions; and a holder provided with a plurality of engagement portions and the like with which the engaging portions are disengageably engaged.

3 Claims, 9 Drawing Sheets

SHOWCASE WITH AN ILLUMINATING APPARATUS

BACKGROUND OF THE INVENTION

The present invention relates to a showcase in which a display chamber is disposed inside an insulating wall so as to display commodities while cooling the commodities in the display chamber. More particularly, it relates to illumination in the display chamber.

In a showcase heretofore installed in a supermarket, a convenience store or the like, illumination lamps for illuminating the inside of a display chamber, the front part of the showcase and the like are attached in the display chamber formed in a main body (e.g., see JP-A-5-146346). The illumination lamps are attached to the lower surface of a canopy positioned in the front part of the ceiling surface of the display chamber, and the front parts of the lower surfaces of a plurality of shelves in a case where the shelves are provided. As the illumination lamps, fluorescent lamps and the like are usually used, but the lamps have to be replaced owing to the lowering of luminance due to deterioration with an elapse of time, or lighting defect. Moreover, the fluorescent lamps use an alternate current, and hence flicker, which adversely influences eyes.

To solve the problem, heretofore, a showcase has been developed which employs an LED illumination apparatus comprising a plurality of LED elements as an illumination apparatus, thereby illuminating the inside of the display chamber.

Such an LED illumination apparatus comprises a substrate provided with the plurality of LED elements, a heat radiation member, a reflective plate, a shade positioned on the side of at least the light emitting surfaces of the LED elements, an attachment member and the like. The LED elements have a high directivity, and the irradiation angles of the elements can arbitrarily be changed, whereby an illumination effect in the display chamber can be improved.

As a constitution in which the irradiation angle of light by the LED illumination apparatus can arbitrarily be changed, there is suggested a constitution in which the angle of the attachment member attached on a showcase side can arbitrarily be regulated, or a constitution in which the LED illumination apparatus can be held at a predetermined angle by an engaging member such as a holder (e.g., a clip constituted of a pair of leg portions having elasticity) attached on the showcase side.

However, in the case of the employment of the attachment member which is attached on the showcase side and whose angle itself can arbitrarily be regulated, the constitution becomes complicated, which causes problems such as the increase of the number of components, the lowering of productivity, and cost increase.

Moreover, in the constitution in which the LED illumination apparatus is held by the holder attached on the showcase side, for example, an LED illumination apparatus 100 shown in FIG. 11 is employed. The LED illumination apparatus 100 is constituted of a substrate 102 provided with a plurality of LED elements 101 arranged in a longitudinal direction, a fixing member 103 for fixing the substrate 102, and a shade 104 provided with the fixing member 103 and configured to surround the LED elements 101, the substrate 102, the fixing member 103 and the like.

In this case, the shade 104 has a substantially semi-cylindrical section including an arc-like section on the side of the light emitting surfaces of the LED elements 101. In consequence, an engaging member such as the holder nips a pair of corner portions 105, 105 where the arc and chord of the substantially semicircular section intersect with each other, thereby detachably holding the LED illumination apparatus 100, but the member has the substantially semicircular shape, and the angles of the corner portions 105 are as large as about 90°, which causes a problem that it is difficult to stably nip and hold the apparatus by the engaging member.

To solve the problem, it is suggested that the corner portions 105 be simply formed into a shape having an acute angle, but in this case, corners are formed in the shade 104 on the side of the light emitting surfaces of the LED elements, and lines due to the corners are formed in the irradiation light from the LED elements 101, which causes a problem that appropriate illumination cannot be realized.

The present invention has been developed to solve such conventional technical problems, and an object thereof is to provide a showcase comprising an illumination apparatus which can stably be held by a simple structure and which can illuminate the inside of a display chamber effectively without any unevenness.

SUMMARY OF THE INVENTION

According to a first aspect of the present invention, there is provided a showcase in which the inside of a display chamber disposed in a main body is illuminated by an illumination apparatus, wherein the illumination apparatus comprises LED elements, a shade member in which the LED elements are received, and a holder attached to the main body to hold the shade member, the shade member comprises a light-transmitting front wall positioned on the side of the light emitting surfaces of the LED elements, and a back wall positioned on the side of the substrate provided with the LED elements, the front wall comprises a curved portion disposed so as to face the LED elements and having an arc-like section, and a pair of flat portions extended continuously from both ends of the curved portion to intersect with the back wall at an acute angle, corner portions where the flat portions intersect with the back wall are a pair of engaging portions, the holder is provided with engagement portions with which the engaging portions are disengageably engaged, and a plurality of engagement portions with which at least one of the engaging portions is engaged are provided.

According to a second aspect of the present invention, in the above showcase, the shade member comprises a hollow shade main body comprising a front wall and a back wall, and end caps attached so as to close both end openings of the shade main body in a longitudinal direction, the outer surface of each of the end caps is provided with a depressed groove which opens in at least the end of the shade main body on a back wall side, and this depressed groove is provided with drawing holes through which wiring lines from the substrate are drawn.

According to the first aspect of the present invention, in the showcase in which the inside of the display chamber disposed in the main body is illuminated by the illumination apparatus, the illumination apparatus comprises the LED elements, the shade member in which the LED elements are received, and the holder attached to the main body to hold the shade member. The shade member comprises the light-transmitting front wall positioned on the side of the light emitting surfaces of the LED elements, and the back wall positioned on the side of the substrate provided with the LED elements. The front wall comprises the curved portion disposed so as to face the LED elements and having the arc-like section, and the pair of flat portions extended continuously from both the ends of the curved portion to intersect with the back wall at the acute angle, and the corner portions where the flat portions intersect with the back wall are the pair of engaging portions. Moreover, the holder is provided with the engagement portions with which the engaging portions are disengageably engaged, whereby the pair of engaging portions of the shade member can disengageably and stably be engaged with the pair of engagement portions of the holder attached to the main body.

In particular, the shade member is provided with a pair of engaging portions constituted of the flat portions and the back wall which forms the acute angle with the flat portions, and hence as compared with a conventional case where the shade member is engaged with engaging portions constituted of a curved surface and a back wall, engaging properties with respect to the holder can be satisfactory, and it is possible to eliminate a disadvantage that the illumination apparatus drops down owing to insufficient engaging.

Moreover, in the present invention, the curved portion having the arc-like section and the flat portions are continuously formed in the shade member, whereby it is possible to avoid a disadvantage that a corner is formed in a connected part between the portions, and it is also possible to eliminate illumination unevenness owing to a line which appears in irradiation light from the LED elements.

Furthermore, the holder is provided with the plurality of engagement portions engaged with at least one of the engaging portions of the shade member, whereby the angle of the irradiation light of the LED elements can easily be regulated.

Moreover, according to the second aspect of the present invention, in addition to the above aspect of the invention, the shade member comprises the hollow shade main body comprising the front wall and the back wall, and the end caps attached so as to close both the end openings of the shade main body in the longitudinal direction. The outer surface of each of the end caps is provided with the depressed groove which opens in at least the end of the shade main body on the back wall side, and this depressed groove is provided with the drawing holes through which the wiring lines from the substrate are drawn. In consequence, the wiring lines drawn from the substrate in the shade main body can be drawn externally through the drawing holes of the end cap, received in the depressed groove of the end cap and subjected to a wiring line treatment.

Therefore, the present invention is effective especially when the end cap of the illumination apparatus is provided close to the wall of the showcase main body or the like.

DETAILED DESCRIPTION OF THE PREFERRED EMBODIMENT

Figure 1:
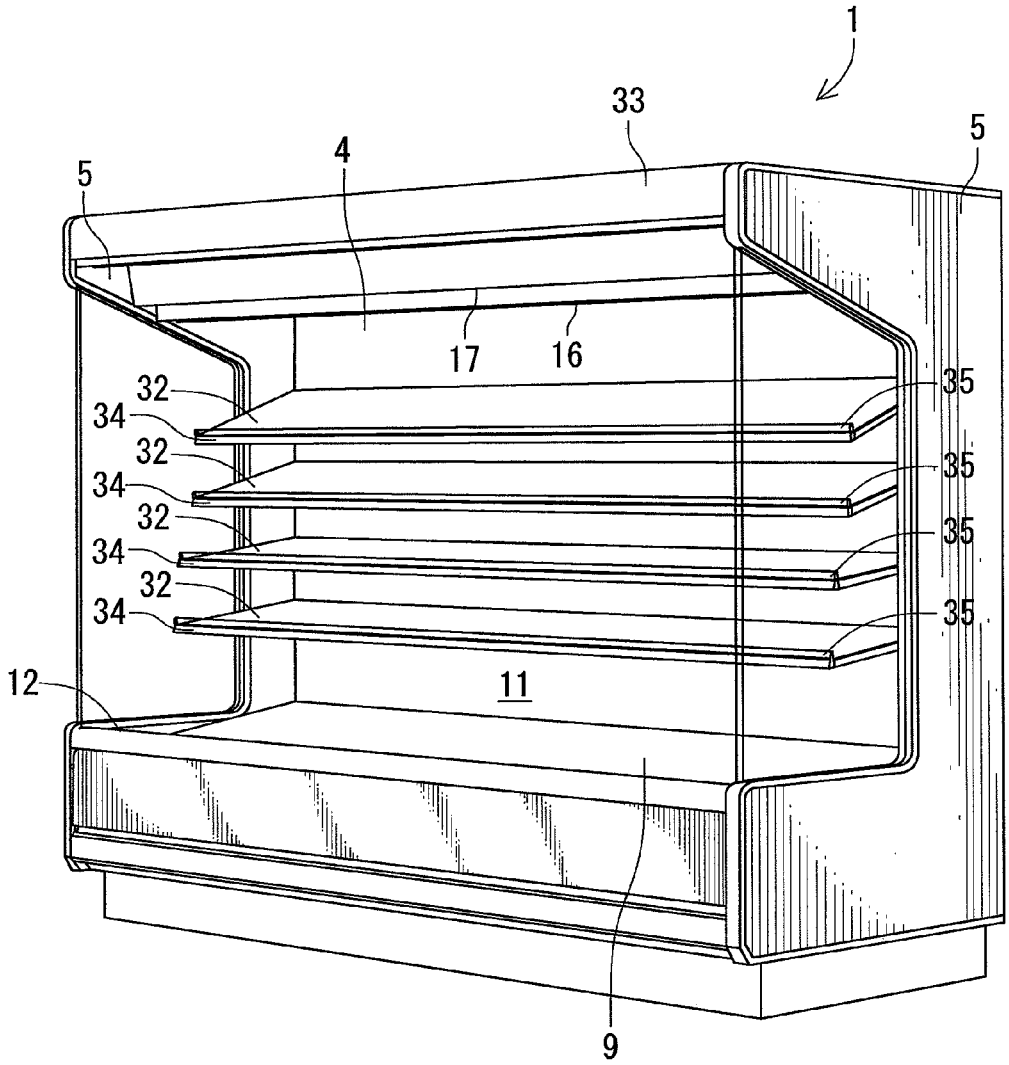
FIG. 1 is a perspective view of an open showcase to which the present invention is applied.
Figure 2:
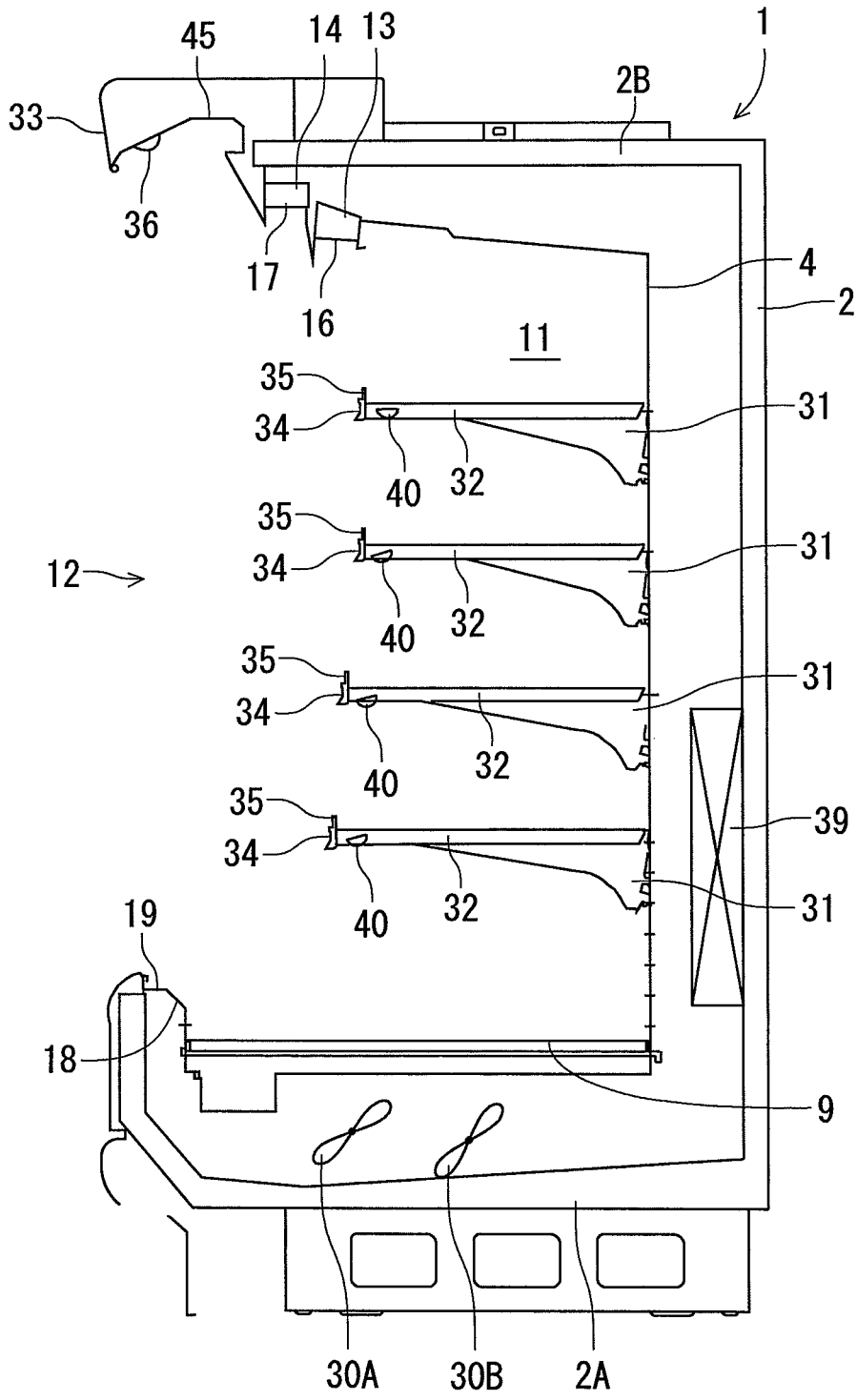
FIG. 2 is a vertical side view of the open showcase of FIG. 1.

Next, an embodiment of the present invention will be described in detail with reference to the drawings. FIG. 1 shows a perspective view of an open showcase 1 to which the present invention is applied, and FIG. 2 shows a vertical side view of the open showcase 1 of FIG. 1, respectively. The open showcase 1 is, for example, a vertical type open showcase as the showcase of the present invention installed in a store such as a supermarket, and is constituted of an insulating wall (a main body) 2 which opens in a front surface and which has a substantially U-shaped section, and insulating side plates 5, 5 which are attached to the side surfaces of the insulating wall 2 in an installation spot.

On the inner side of the insulating wall 2 of the open showcase 1, a partition plate 4 and another partition plate (not shown) are attached with spaces being left therebetween, and two inner and outer layer ducts (not shown) are formed between the partition plates 4 and the insulating wall 2. In the front part of the lower end of the inner partition plate 4, a bottom plate 9 is attached with a space for the duct being left between the bottom plate and a bottom wall 2A of the insulating wall 2, and a display chamber 11 is disposed inside the partition plates 4 and the bottom plate 9.

Moreover, in the display chamber 11, a pair of brackets 31 whose heights and attachment angles can be changed and which are attached to supports (not shown) in the inner back part of the display chamber 11 as well as a shelf plate 32 constituting a shelf together with the brackets are arranged in a plurality of stages. At the front edges of the shelf plates 32, price rails 34 formed of a hard synthetic resin are attached, and the price rails 34 also serve as ornamental members of the shelf plates 32. Furthermore, predetermined spaces are formed between the front edges of the shelf plates 32 and the price rails 34, and guards 35 for preventing commodities on the shelf plates 32 from dropping down are attached in the spaces.

In addition, the lower surfaces of the shelf plates 32 are provided with illumination apparatuses 40 which illuminate the commodities on the shelf plates 32 disposed on the downside and the front part of the display chamber 11 as described later in detail.

Along the upper edge of a front opening 12 of the insulating wall 2, an inner layer discharge port 16 and an outer layer discharge port 17 provided with honeycomb members 13, 14, respectively, are arranged side by side, and the inner layer discharge port 16 and the outer layer discharge port 17 are connected to the inner layer duct and the outer layer duct, respectively. Moreover, along the lower edge of the opening 12, an inner layer suction port 18 and an outer layer suction port 19 are provided side by side.

On the other hand, blowers 30A, 30B corresponding to the inner layer duct and the outer layer duct, respectively, are installed on the bottom wall 2A of the insulating wall 2 in the rear part of the display chamber under the bottom plate 9.

In the inner layer duct behind the back part partition plate 4, a cooling unit 39 of a cooling apparatus is vertically provided, whereby when the blower corresponding to the inner layer duct is operated, cold air subjected to heat exchange between the air and the cooling unit is raised through the inner layer duct and discharged toward the inner layer suction port 18 through the inner layer discharge port 16. Then, the cold air sucked into the inner layer suction port 18 is again accelerated by the blower.

On the other hand, when the blower corresponding to the outer layer duct is operated, air in the outer layer duct is raised through the outer layer duct and discharged toward the outer layer suction port 19 through the outer layer discharge port 17. Then, the air sucked into the outer layer suction port 19 is again accelerated by the blower. In consequence, in the opening 12, double front and rear air curtains are formed, and a part of the inner cold air curtain is circulated through the display chamber 11 to cool the display chamber 11.

Moreover, in the front end of a top wall 2B of the insulating wall 2, that is, the upper edge of the front opening, a canopy 33 is attached and positioned before the outer layer discharge port 17 so as to project forwards, and on the inner side of the canopy 33, a reflective plate 45 is attached so as to extend externally from the front opening 12 of the display chamber 11. Furthermore, the front portion of the reflective plate 45 is provided with an illumination apparatus 36 for illuminating the inside of the display chamber 11 or the surrounding of the display chamber 11 from the upside. It is to be noted that the illumination apparatus 36 has a constitution substantially similar to the illumination apparatuses 40 attached to the shelf plates 32 as described above, and the detailed constitution thereof will be described later with respect to the illumination apparatuses 40.

Figure 3:
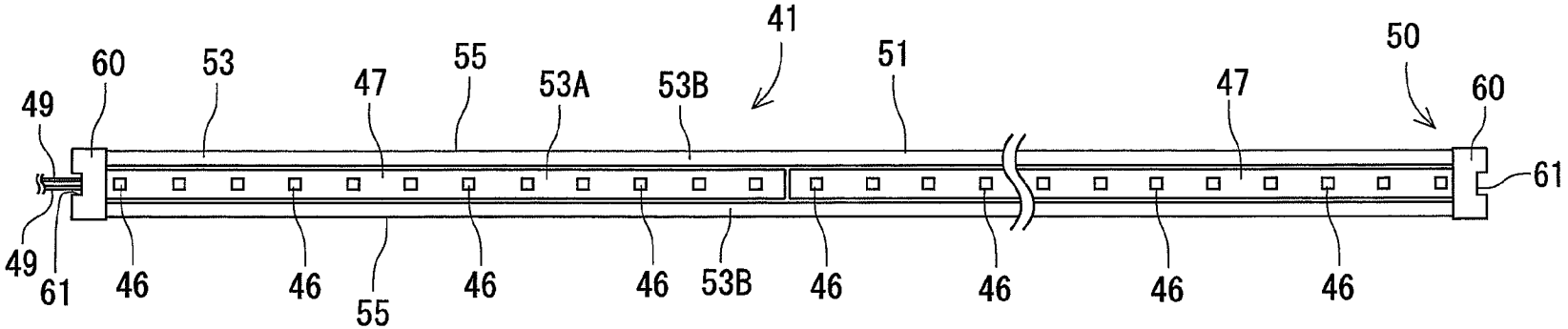
FIG. 3 is a schematic plan view of an illumination member of an illumination apparatus.
Figure 4:
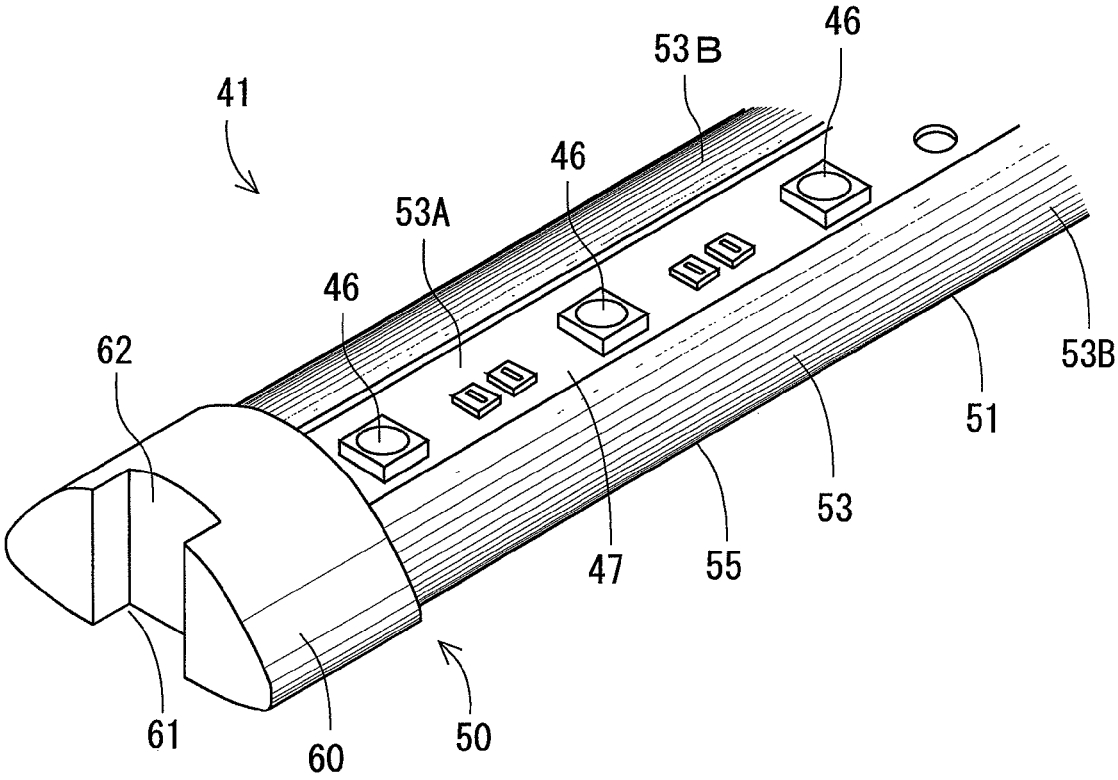
FIG. 4 is a partially enlarged perspective view of the illumination member of FIG. 2.
Figure 5:
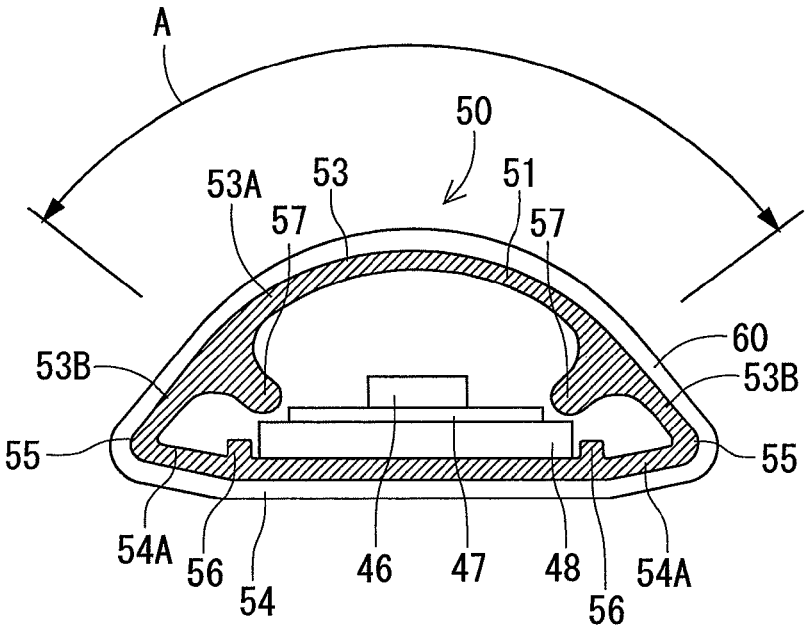
FIG. 5 is a vertical side view of the illumination member.
Figure 6:
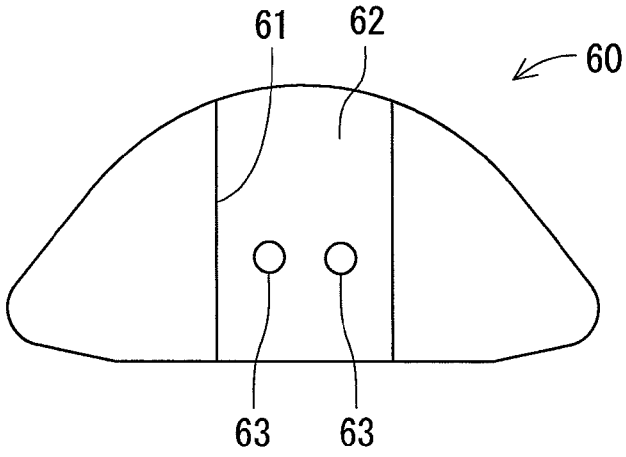
FIG. 6 is a plan view of an end cap.
Figure 7:
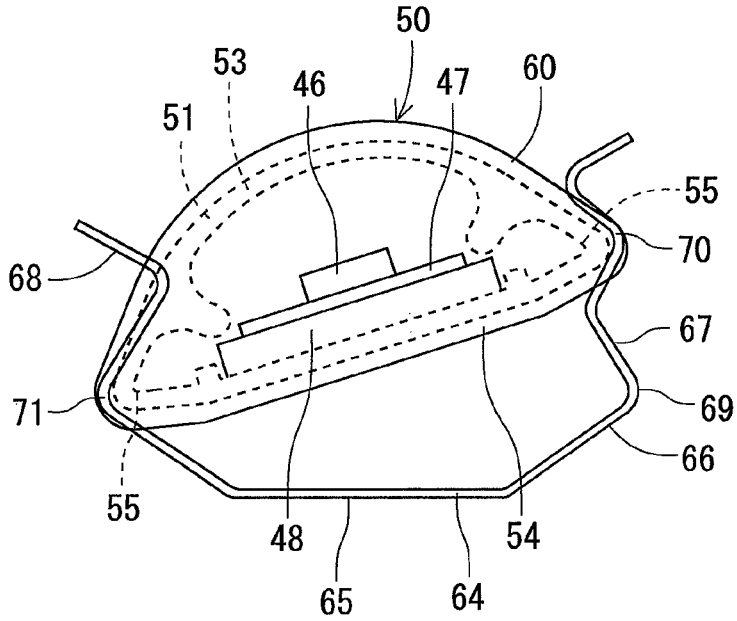
FIG. 7 is a vertical side view of the illumination apparatus having a first attachment angle.
Figure 8:
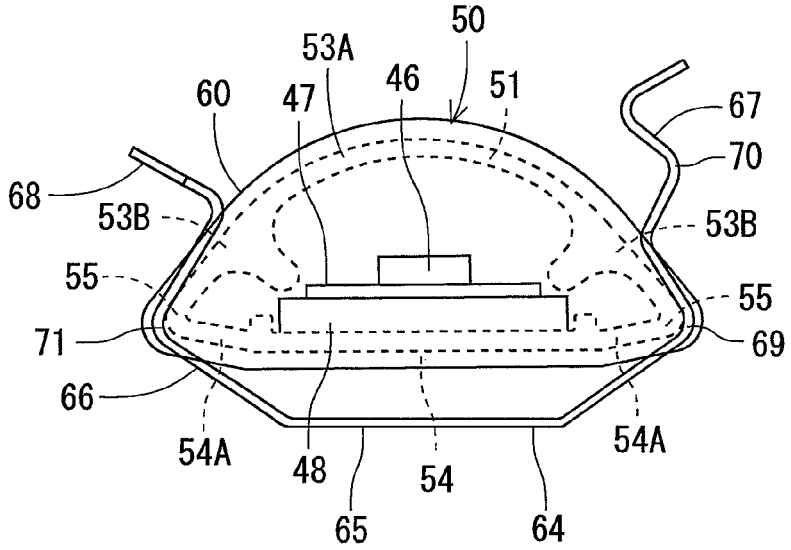
FIG. 8 is a vertical side view of the illumination apparatus having a second attachment angle.
Figure 9:
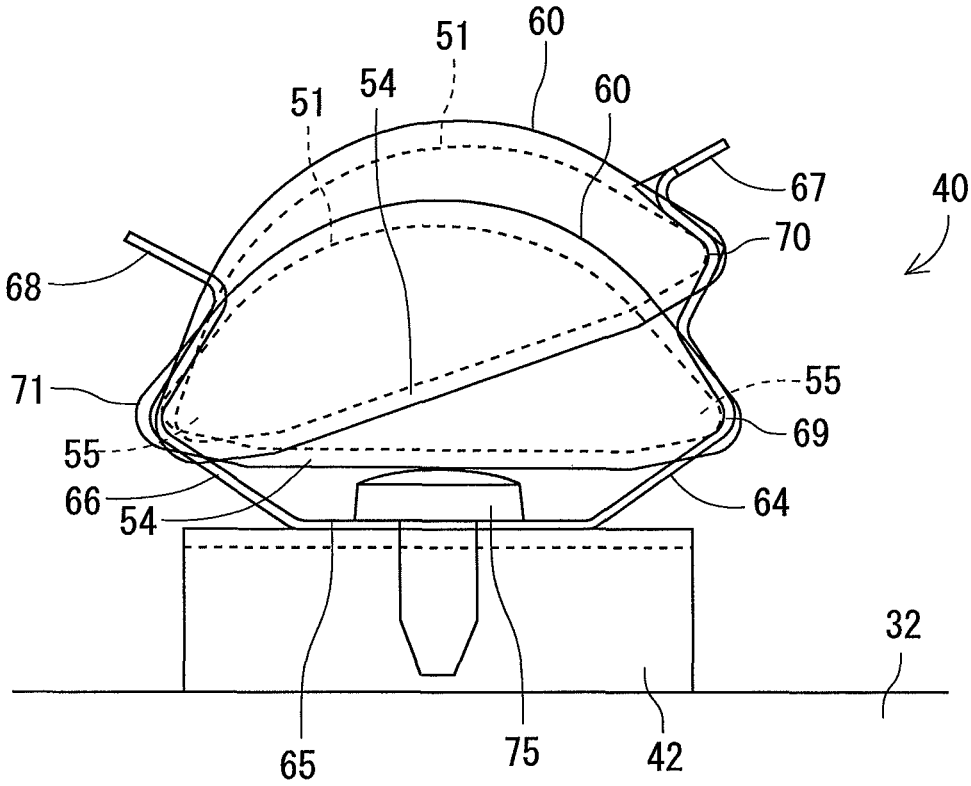
FIG. 9 is a vertical side view of the illumination apparatus attached on a main body side (a shelf plate)
Figure 10:
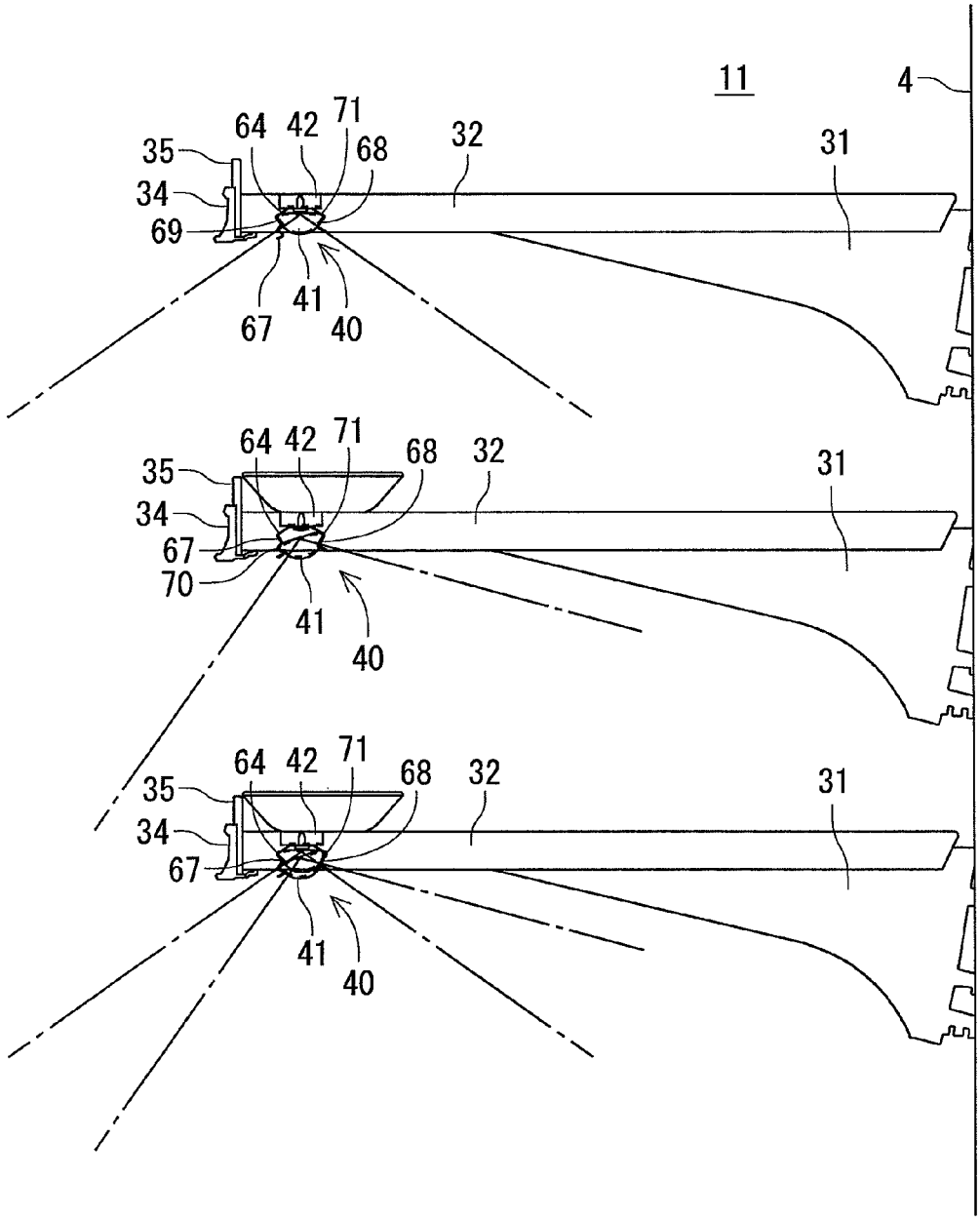
FIG. 10 is a schematic explanatory view showing an illumination state by the respective illumination apparatuses.
Figure 11:
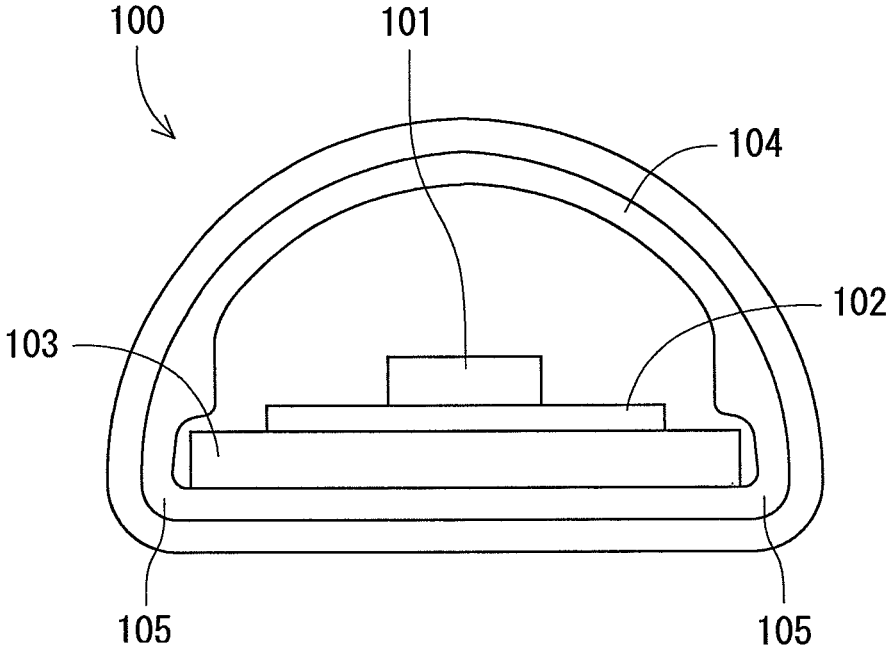
PRIOR ART FIG. 11
FIG. 11 is a vertical side view of an illumination apparatus employed in a conventional showcase.

Each of the illumination apparatuses 40 in the present embodiment is constituted of an illumination member 41 and a holder 64 which detachably holds the illumination member 41. Hereinafter, the constitution of the illumination apparatus 40 (the illumination apparatus 36) will be described in detail with reference to FIGS. 3 to 10. FIG. 3 shows a schematic plan view of the illumination member 41 of the illumination apparatus 40, FIG. 4 shows a partially enlarged perspective view of the illumination member 41 of FIG. 3, FIG. 5 shows a vertical side view of the illumination member 41, FIG. 6 shows a plan view of an end cap 60, FIG. 7 shows a vertical side view of the illumination apparatus 40 having a first attachment angle, FIG. 8 shows a vertical side view of the illumination apparatus 40 having a second attachment angle, FIG. 9 shows a vertical side view of the illumination apparatus 40 attached on a main body side (the shelf plate 32), and FIG. 10 shows a schematic explanatory view showing an illumination state by the respective illumination apparatuses 40, respectively. It is to be noted that in FIGS. 4, 5, 7 to 9, the light emitting surface of an LED element 46 is shown on the upside.

The illumination member 41 is constituted of a substrate 47 provided with a plurality of LED elements 46, an attachment member 48, and a shade member 50. The substrate 47 is disposed so as to extend in a longitudinal direction, and in the substrate 47, the plurality of LED elements 46 are attached with a predetermined space being left therebetween as shown in FIG. 3. Each LED element 46 of the present embodiment is a chip type white LED element. In the present embodiment, the front opening 12 of the open showcase 1 is extended as much as about 1830 mm (6 shaku), and hence about 108 LED elements 46 are used.

The attachment member 48 is a thermally conductive member extended over the longitudinal direction of the front opening 12 in the same manner as in the substrate 47, and the surface of the substrate 47 on a side opposite to the attachment surface of the LED element 46 is fixed to the attachment member 48 via screws or the like. It is to be noted that the attachment member 48 is fixed to the inner surface of a back wall 54 of a shade main body 51 described later by an adhesive or the like.

Next, a constitution of the shade member 50 in the present embodiment will be described with reference to FIG. 5. The shade member 50 is constituted of the internally hollow shade main body 51 whose both ends open in the longitudinal direction, and the end caps 60, 60 attached so as to close both the end openings.

The shade main body 51 is made of a light-transmitting material, that is, a light-transmitting, colorless and transparent material in the present embodiment, for example, a synthetic resin such as acryl or polycarbonate (PC), and in the shade main body, the LED elements 46, the substrate 47 and the attachment member 48 are received. It is to be noted that FIGS. 3 and 4 show a state in which the substrate 47, the LED elements 46 and the like disposed inside are seen through the shade main body 51. It is to be noted that in the present embodiment, in the shade main body 51, the LED elements 46, the substrate 47 and the attachment member 48 are received, but additionally a reflective plate, a lens and the like (not shown) may be received in the shade main body 51 so as to effectively use irradiation light from the LED elements 46 during illumination.

As shown by hatching in FIG. 5, the shade main body 51 is constituted of a front wall 53 positioned on the side of the light emitting surfaces of the LED elements 46, and the back wall 54 positioned on the side of the substrate 47. In the present embodiment, the whole shade main body 51 is made of the light-transmitting material, but the present invention is not limited to this embodiment, and at least the front wall 53 may only be made of a material having light transmitting properties.

The front wall 53 is constituted of a curved portion 53A and flat portions 53B, 53B continuously disposed from both ends of the curved portion 53A. The curved portion 53A is formed so as to face the LED element 46, and has an arc-like section. The arc may be, for example, an arc of a circle around substantially the center of the section of the back wall 54. It is to be noted that in FIG. 5, a region of a solid arrow A shows the region of the curved portion 53A.

Moreover, both the ends of the curved portion 53A are provided with planes extending continuously from the curved portion 53A in the tangential direction of the arc, and the planes are the flat portions 53B, 53B, respectively. It is to be noted that a joined part between each flat portion 53B and the curved portion 53A does not have any corner, because the flat portion 53B is continuously formed so as to extend in the tangential direction of the arc of the curved portion 53A as described above.

On the other hand, the back wall 54 has such a planar shape as to face the curved portion 53A, and both ends of the back wall 54 are provided with flat faces 54A, 54A tilted a little (at a predetermined angle) on the side of the curved portion 53A. Moreover, corner portions where the ends of the back wall 54 intersect with the respective flat portions 53B at an acute angle, that is, corner portions where the flat faces 54A, 54A make an acute angle with the flat portions 53B, 53B of the front wall in the present embodiment are a pair of engaging portions 55, 55. It is to be noted that in the present embodiment, end surfaces where the flat faces 54A intersect with the flat portions 53B are chamfered.

On the inner surface of the back wall 54, the attachment member 48 provided with the substrate 47 is attached and fixed by an adhesive or the like. Here, on the inner surface of the back wall 54, a pair of back wall side projecting portions 56, 56 which are positioned on both sides of the attachment member 48 to be attached and which project inwardly are formed integrally with the back wall 54.

Moreover, on the inner surfaces of the flat portions 53B, 53B of the front wall 53, a pair of front wall side projecting portions 57, 57 which project inwardly so as to come close to the ends of the attachment member 48 or the substrate 47 to be attached inside are formed integrally with the front wall 53. It is to be noted that in the present embodiment, the front wall side projecting portions 57 are formed on the inner surfaces of the flat portions 53B of the front wall 53, but the present invention is not limited to this embodiment, and the front wall side projecting portions may be provided on the inner surface of the curved portion 53A.

On the other hand, the end caps 60, 60 attached to both end openings of the shade main body 51 are, for example, tubular rubber caps each having one open end. The section of each end cap is formed in substantially the same shape as the outer shape of the shade main body 51, and is formed to be slightly larger than the section of the shade main body 51 so that the end cap covers the end of the shade main body from the outside.

The end of the shade main body 51 is inserted as much as a predetermined dimension into the end cap 60, whereby the end of the shade main body 51 is openably closed. The closing side end (the outer surface) of the end cap 60 is provided with a depressed groove 61 cut from the end of the shade main body 51 on a back wall 54 side to the end of the front wall 53 on a curved portion 53A side.

The surface of the depressed groove 61 is closed with a closing wall 62, and the closing wall 62 (in the depressed groove 61) which faces the insertion-side opening of the shade main body 51 is provided with drawing holes 63, 63 through which wiring lines 49 (see FIG. 3) are drawn to the outside from the substrate 47 provided in the shade main body 51 (see FIG. 6).

It is to be noted that in the present embodiment, the depressed groove 61 is formed from the end of the shade main body 51 on the back wall 54 side to the end of the front wall 53 on the curved portion 53A side in consideration of the processing properties of the end cap 60, but the present invention is not limited to this embodiment, and the depressed groove may be opened in at least the end of the shade main body 51 on the back wall 54 side.

Next, the holders 64 which hold the illumination member 41 will be described with reference to FIGS. 7 to 9. The holders 64 are positioned in at least both ends (both side portions) of the illumination member 41 provided so as to extend in the longitudinal direction of the shelf plate 32, to detachably hold the illumination member 41. In the present embodiment, the holders 64 are made of a synthetic resin such as polycarbonate (PC), and each holder is integrally constituted of a fixing portion 65 and a nipping portion 66 having elasticity.

The fixing portion 65 is substantially horizontally disposed with respect to the attachment surface of the illumination apparatus 40, that is, the front part of the lower surface of the shelf plate 32 (the attachment surface of the canopy 33 in the case of the illumination apparatus 36), and the fixing portion 65 is provided with an attachment hole (not shown).

Moreover, the nipping portion 66 is constituted of two nipping pieces 67, 68 bent at a predetermined angle from the ends of the fixing portion 65 facing each other as shown in FIG. 7, that is, both ends of the fixing portion positioned in a direction perpendicularly crossing the longitudinal direction of the held illumination member 41 (the front and rear ends thereof in the present embodiment, because the illumination member 41 is attached so as to extend in a horizontal direction). In the present embodiment, the illumination apparatus 40 is attached to the lower surface of the shelf plate 32 to illuminate the upper surface of the shelf plate 32 positioned under the upper shelf plate 32, and hence the nipping pieces 67, 68 are formed so as to extend downwards from the front and rear ends of the fixing portion 65.

In the present embodiment, the nipping piece 67 formed at the front end of the fixing portion 65 is bent away from the other nipping piece 68, and bent so as to come close to the nipping piece 68, thereby forming a first engagement portion 69. Furthermore, at the end of the first engagement portion 69, the nipping piece is further bent away from the other nipping piece 68, and then bent so as to come close to the nipping piece 68, thereby forming a second engagement portion 70.

The nipping piece 68 formed at the rear end of the fixing portion 65 is bent away from the nipping piece 67, and then bent so as to come close to the nipping piece 67, thereby for an engagement portion 71. It is to be noted that the engagement portion 71 formed in the nipping piece 68 is formed in such a position as to face the first engagement portion 69 formed in the nipping piece 67 substantially in parallel with the fixing portion 65.

Moreover, the ends of the second engagement portion 70 and the engagement portion 71, that is, the ends of the nipping pieces 67, 68 are bent away from each other again. In consequence, the nipping portion 66 has a constitution in which the nipping pieces 67, 68 can constantly exert an urging force inwardly, and a holding space is formed between the nipping pieces 67 and 68 so that the pair of engaging portions 55, 55 of the illumination member 41 can be disengageably engaged.

The holder 64 is beforehand fixed to the attachment position of the illumination apparatus 40 (the illumination member 41), that is, the front part of the lower surface of the shelf plate 32 by use of an attachment member 42 via, for example, a screw 75 as shown in FIG. 9. Here, the holders 64 are beforehand fixed to positions where the nipping portions 66 correspond to both side portions of the illumination member 41 (positions where the illumination member 41 can stably be held by at least two holders 64).

An attachment method of the illumination apparatus 40 having the above constitution will be described. First, the illumination member 41 is assembled. That is, the attachment member 48 fixed to the substrate 47 provided with the LED elements 46 is inserted into the end opening of the shade main body 51 on one side, whereby the LED elements 46, the substrate 47 and the attachment member 48 are received in the shade main body 51.

At this time, the attachment member 48 attached to the surface of the substrate 47 opposite to the LED elements 46 is fixed while abutting on the inner surface of the back wall 54 of the shade main body 51. It is to be noted that the fixing position of the attachment member 48 can easily be determined by the back wall side projecting portions 56, 56 formed on the inner surface of the back wall 54 of the shade main body 51.

Moreover, in addition to the back wall side projecting portions 56, 56, the front wall side projecting portions 57, 57 projecting inwardly as described above are formed on the inner surface of the front wall 53 of the shade main body 51 so as to come close to the received attachment member 48 or substrate 47, whereby it is possible to suppress a disadvantage that the substrate 47 provided with the attachment member 48 and the LED elements 46 drops down from the back wall 54 of the shade main body 51.

The light emitting surfaces of LED elements 46 provided in this state on the substrate 47 face the front wall 53 (the curved portion 53A) having the light-transmitting properties.

Then, both side ends of the shade main body 51 are closed with the end caps 60, 60. It is to be noted that one of the end caps 60 may beforehand be attached, when the substrate 47 and the like are inserted. Then, the wiring lines 49 from the substrate 47 are drawn externally through the drawing holes 63 formed in the end cap 60, and received along the depressed groove 61 provided with the drawing holes 63.

The illumination member 41 assembled in this manner is attached to the lower ends of the pair of holders 64 beforehand attached to the front part of the lower surface of each shelf plate 32. The engaging portion 55 positioned on one side, for example, the rear side of the shade main body 51 is inserted into the nipping portion 66 of the holder 64 from the downside, and engaged with (pushed into) the engagement portion 71 formed in the nipping piece 68. Afterward, the engaging portion 55 positioned on the other side, that is, on the front side in this case is engaged with the first engagement portion 69 or the second engagement portion 70 formed in the nipping piece 67. In consequence, the shade main body 51 is held in the holding space formed between the nipping pieces 67 and 68 of the nipping portion 66 by use of the elastic force of the nipping portion.

At this time, while moving the nipping pieces 67, 68 made of an elastic material away from each other, the engaging portions 55, 55 of the shade main body 51 can easily be inserted into and engaged with the nipping pieces 67, 68. Moreover, the nipping pieces 67, 68 constantly exert the urging force inwardly, and can securely hold the shade main body 51.

In particular, the pair of engaging portions 55, 55 engaged with the engagement portions 69, 70 and 71 of the holder 64 are a pair of corner portions formed by the back wall 54 (the flat faces 54A, 54A formed at both ends of the back wall 54 in the present embodiment) and the flat portions 53B, 53B intersecting with the back wall at the acute angle. Therefore, as compared with a conventional constitution in which the engagement portions are engaged with engaging portions constituted of a curved surface and a back wall, engagement properties with respect to the holders 64 can be satisfactory.

Moreover, the engaging portion 55 is constituted of the flat face 54A and the flat portion 53B, and can thus easily be engaged with the engagement portion of the holder 64, thereby realizing stable engagement, so that it is possible to eliminate a disadvantage that the illumination member 41 drops down owing to insufficient engaging.

In addition, the nipping pieces 67, 68 of the holder 64 are made of the elastic material, and can disengageably and stably engage with and hold the illumination member 41.

Moreover, in the shade main body 51 according to the present invention, the curved portion 53A having the arc-like section and the flat portion 53B are continuously formed, which can avoid a disadvantage that a corner is formed in a connected part between the portions. Furthermore, the formation of a line in irradiation light from the LED elements 46 due to the corner can be eliminated, and appropriate illumination without any unevenness can be realized.

When the illumination apparatus 40 illuminates right under the apparatus, one of the engaging portions 55 of the illumination member 41 shown in FIG. 8 in the illumination apparatus 40 provided on the top shelf plate 32 of FIG. 10 is engaged with the first engagement portion 69 of the one nipping piece 67 of the holder 64, and the other engaging portion 55 is engaged with the engagement portion 71 of the other nipping piece 68.

In consequence, the illumination member 41 is attached substantially horizontally with respect to the lower surface of the shelf plate 32, and the light from each LED element 46 is emitted directly below. Therefore, the upper front part of the shelf plate 32 provided under the upper shelf plate 32, the front part of the shelf plate 32 and the like can effectively be illuminated.

On the other hand, when the illumination apparatus 40 illuminates an obliquely rear lower part, the one engaging portion 55 of the illumination member 41 shown in FIG. 7 in the illumination apparatus 40 provided on the middle shelf plate 32 of FIG. 10 is engaged with the second engagement portion 70 formed toward the end (on the downside) from the first engagement portion 69 of the one nipping piece 67 of the holder 64, and the other engaging portion 55 is engaged with the engagement portion 71 of the other nipping piece 68.

In consequence, the illumination member 41 is tilted at a predetermined angle and attached to the shelf plate 32 so that the front end of the member lowers and so that the rear end thereof rises, and the light from each LED element 46 is emitted to the obliquely rear lower part. Therefore, the upper front part, the center and the like of the shelf plate 32 provided under the upper shelf plate 32 can more effectively be illuminated.

Consequently, in the present embodiment, the holder 64 is provided with a plurality of engagement portions (the first engagement portion 69 and second engagement portion 70 of the nipping piece 67) with which at least one engaging portion 55 of the shade main body 51 is engaged, so that the angle of the irradiation light of each LED element 46 can easily be regulated. Moreover, according to the present embodiment, the angle of the illumination apparatus 40 can arbitrarily be regulated by a simple constitution, whereby the number of components can be decreased, and productivity improvement and cost reduction can be realized.

It is to be noted that in the present embodiment, a plurality of engagement portions with which the engaging portion 55 is engaged positioned on the front side of the illumination member 41 are only formed, but the present invention is not limited to this embodiment, and a plurality of engagement portions with which the engaging portion 55 is engaged positioned on the rear side may be formed. In consequence, a combination of the engagement portions engaged with the engagement portions 55, 55 of the illumination member 41 is changed, whereby the illumination at many irradiation angles by the illumination apparatuses 40 can be realized. Therefore, an illumination effect can further be improved.

Moreover, the wiring lines 49 from the substrate 47 are drawn through the drawing holes 63 of the end cap 60 from the end of the illumination member 41 attached to the front part of the lower surface of the shelf plate 32 as described above. In the present embodiment, the outer surface of the end cap 60 is provided with the depressed groove 61 cut from the end of the shade main body 51 on the back wall 54 side to the end of the front wall 53 on the curved portion 53A side. In consequence, the wiring lines 49 drawn externally through the drawing holes 63 can be received in the depressed groove 61 and subjected to a wiring line treatment.

According to such a constitution, especially when the end caps 60 of the illumination apparatuses 40 are arranged close to the walls of the showcase main body, the inner wall surfaces of the side plates 5 of the display chamber 11 and the like, the wiring lines 49 can appropriately be treated. Therefore, the wiring lines 49 are not easily seen from the outside, and hence appearance can be improved.

It is to be noted that in the present embodiment, the depressed groove 61 is cut from the end of the shade main body 51 on the back wall 54 side to the end of the front wall 53 on the curved portion 53A side in consideration of the processing properties, but the depressed groove may be formed so as to open in at least the end of the shade main body 51 provided with the substrate 47 on the back wall 54 side, thereby exerting the above-mentioned effect. In this case, the end of the end cap 60 on the front wall 53 side is closed, whereby the wiring lines 49 received in the depressed groove are not easily seen from the outside, so that the appearance can be improved.

In the present embodiment, the illumination apparatus 40 provided on the front part of the lower surface of the shelf plate 32 has been described as an example, but the present invention is not limited to this example, and the present invention is effective even for the illumination apparatus 36 provided in the canopy 33, an illumination apparatus provided on the surface of the ceiling of the display chamber 11 or the like.

What is claimed is:

1. A showcase in which an inside of a display chamber disposed in a main body is illuminated by an illumination apparatus, said illumination apparatus comprising:

an attachment member;

a substrate located on a surface of the attachment member;

LED elements provided on a surface of the substrate;

a hollow shade member in which the LED elements are received, said hollow shade member comprising an internally hollow shade main body whose both ends open in a longitudinal direction; and a holder attached to the main body, said holder configured to hold the hollow shade member, the hollow shade member further comprising a light-transmitting front wall positioned on the side of the light emitting surfaces of the LED elements, and a back wall positioned on a side of the substrate opposite to the side provided with the LED elements, the front wall comprising a curved portion disposed so as to face the LED elements and having an arc-like section, and a pair of flat portions extended continuously from both ends of the curved portion to intersect with the back wall extended continuously from both ends of the flat portions at an acute angle, corner portions where the flat portions intersect with the back wall are a pair of engaging portions, a pair of back wall projections integral with the back wall and positioned on both sides of the attachment member, a pair of front wall projections integral with the front wall, and the holder comprises a first engagement portion and a second engagement portion configured to disengage and engage with at least one of the engaging portions of the hollow shade member, and the second engagement portion is formed downside from the first engagement portion.

2. The showcase according to claim 1, the shade member further comprising:

end caps attached to the shade body so as to close both end openings of the hollow shade main body in a longitudinal direction, wherein the outer surface of each of the end caps is provided with a depressed groove which opens in at least the end of the hollow shade main body on a back wall side, and the depressed groove is provided with drawing holes through which wiring lines from the substrate are drawn.

3. The showcase according to claim 1, wherein the pair of front wall projections extend to a position close to the attachment member or the substrate located on the surface of the attachment member.

* * * * *